US010967487B2

(12) United States Patent
Hita et al.

(10) Patent No.: US 10,967,487 B2
(45) Date of Patent: Apr. 6, 2021

(54) THREADED MEMBER TIGHTENING TOOL AND COUNTING APPARATUS

(71) Applicant: NITTO KOHKI CO., LTD., Tokyo (JP)

(72) Inventors: Hirokazu Hita, Tokyo (JP); Kenji Otsuka, Tokyo (JP)

(73) Assignee: NITTO KOHKI CO., LTD., Tokyo (JP)

( * ) Notice: Subject to any disclaimer, the term of this patent is extended or adjusted under 35 U.S.C. 154(b) by 235 days.

(21) Appl. No.: 15/880,703

(22) Filed: Jan. 26, 2018

(65) Prior Publication Data

US 2018/0185993 A1 Jul. 5, 2018

Related U.S. Application Data

(63) Continuation of application No. PCT/JP2016/076320, filed on Sep. 7, 2016.

(30) Foreign Application Priority Data

Sep. 8, 2015 (JP) ..... JP2015-176353

(51) Int. Cl.
*B25B 21/00* (2006.01)
*B25B 23/147* (2006.01)
(Continued)

(52) U.S. Cl.
CPC ..... *B25B 21/002* (2013.01); *B25B 23/14* (2013.01); *B25B 23/147* (2013.01); *B25F 5/001* (2013.01); *G06M 3/06* (2013.01)

(58) Field of Classification Search
CPC ..... B25B 21/002; B25B 23/14; B25B 23/147; B25B 21/00; G06M 3/06; B25F 5/001; B25C 1/047; B25C 1/003; B25C 1/06
(Continued)

(56) References Cited

U.S. PATENT DOCUMENTS 3,457,780 A * 7/1969 Agostini ..... G01L 25/003 73/862.08
3,828,318 A * 8/1974 Bennett ..... G05B 19/409 700/180
(Continued)

FOREIGN PATENT DOCUMENTS

JP 2005-125464 5/2005
JP 2007-111797 5/2007
(Continued)

OTHER PUBLICATIONS

International Search Report dated Oct. 18, 2016 in International (PCT) Application No. PCT/JP2016/076320.

*Primary Examiner* — Robert F Long
(74) *Attorney, Agent, or Firm* — Wenderoth, Lind & Ponack, L.L.P.

(57) ABSTRACT

Provided is a threaded member tightening tool capable of returning a count value in linkage with reverse driving by the threaded member tightening tool and only when a threaded member to be removed by the reverse driving has been counted as a tightened threaded member. A computing unit of a motor-driven screwdriver is switchable between a counting mode in which the computing unit counts the number of tightened threaded members and holds the counted number as a count value and a count return mode for returning the count value to a one-preceding count value. The computing unit returns the count value to a one-preceding count value based on the fact that the engaging element fitting unit has been driven in the reverse direction when the computing unit has been switched to the count return mode.

16 Claims, 6 Drawing Sheets

(51) Int. Cl.
*B25B 23/14* (2006.01)
*B25F 5/00* (2006.01)
*G06M 3/06* (2006.01)

(58) Field of Classification Search
USPC ..... 173/1–2, 90, 162.1, 213
See application file for complete search history.

(56) References Cited

U.S. PATENT DOCUMENTS 3,941,988 A * 3/1976 Hagstrom ..... G05B 19/25 700/187
3,987,533 A * 10/1976 Sandgren ..... A44B 19/42 29/410
4,091,451 A * 5/1978 Weiner ..... B23P 19/06 700/275
4,110,829 A * 8/1978 Boys ..... B25B 23/1456 173/180
4,121,670 A * 10/1978 Antipov ..... B25B 21/02 173/1
4,158,799 A * 6/1979 Cappel ..... B25B 23/147 173/182
4,251,761 A * 2/1981 Inoue ..... G05B 19/23 318/630
4,358,735 A * 11/1982 Boys ..... B25B 23/14 324/173
4,365,402 A * 12/1982 McCombs ..... B25B 23/14 173/182
4,389,600 A * 6/1983 Milligan ..... B65H 23/1806 242/334.4
4,403,562 A * 9/1983 Tancs ..... D05B 65/00 112/275
4,427,882 A * 1/1984 Nakaoki ..... G01B 11/02 250/231.14
4,446,745 A * 5/1984 Stone ..... B23P 19/066 29/240
4,500,938 A * 2/1985 Dulin ..... B25C 1/06 227/131
4,982,673 A * 1/1991 Kojima ..... D05B 3/14 112/112
5,003,297 A * 3/1991 Hirabayashi ..... B25B 23/00 340/680
5,139,484 A * 8/1992 Hazon ..... A61M 5/1456 128/DIG. 1
5,163,073 A * 11/1992 Chasteen ..... B65B 57/20 377/28
5,203,855 A * 4/1993 Givler ..... B21J 15/10 408/1 R
5,321,935 A * 6/1994 Spatz ..... B67B 3/26 53/490
5,592,396 A * 1/1997 Tambini ..... B25B 23/14 702/179
5,649,451 A * 7/1997 Ruland ..... B23Q 1/4828 74/89.3
5,649,675 A * 7/1997 Phelps ..... A01K 87/04 242/441.2
5,967,721 A * 10/1999 Giachinta ..... F16B 39/282 411/120
6,845,279 B1 * 1/2005 Gilmore ..... G05B 19/406 340/426.1
7,096,569 B1 * 8/2006 Barr ..... B25B 23/14 29/700
7,228,607 B1 * 6/2007 Liu ..... B21J 15/105 29/243.526
2002/0148299 A1 * 10/2002 Leong ..... B23P 19/042 73/761
2006/0047357 A1 * 3/2006 Tanaka ..... G05B 19/186 700/160
2007/0163357 A1 * 7/2007 Nakazawa ..... H02P 7/04 73/761
2008/0196914 A1 * 8/2008 Nakazawa ..... B25B 23/147 173/176
2008/0257577 A1 * 10/2008 Tanaka ..... B25B 21/00 173/4
2010/0140345 A1 * 6/2010 Sakamoto ..... B25B 23/14 235/376
2012/0063563 A1 * 3/2012 Huang ..... B23P 19/06 377/6
2020/0139519 A1 * 5/2020 Banba ..... B25B 23/0057

FOREIGN PATENT DOCUMENTS

JP 2008-279589 11/2008
WO 2006/025181 3/2006
WO 2008/105057 9/2008

* cited by examiner

THREADED MEMBER TIGHTENING TOOL AND COUNTING APPARATUS

TECHNICAL FIELD

The present invention relates to a threaded member tightening tool and a counting apparatus. More specifically, the present invention relates to a threaded member tightening tool used in a tightening operation to tighten threaded members such as screws and nuts, the threaded member tightening tool having a function to count the number of threaded members for which tightening has been completed. The present invention also relates to a counting apparatus communicatively connected to a threaded member tightening tool to count the number of threaded members for which tightening has been completed with the threaded member tightening tool.

BACKGROUND ART

Among threaded member tightening tools, particularly motor-driven screwdrivers used in an assembling operation in a production line, there is one that has a counting function to automatically count the number of tightened threaded members in order to confirm whether or not a preset number of threaded members, e.g. screws or nuts, have been surely tightened. Such a threaded member tightening tool having a counting function usually has a function to judge whether or not a threaded member has been properly tightened by detecting a motor driving time taken to complete tightening of the threaded member, a change in torque, etc., and when a threaded member has been properly tightened, the threaded member is counted into the number of tightened threaded members.

When a screw tightening operation is actually performed by using a motor-driven screwdriver, there may be a failure in the screw tightening operation due, for example, to tightening a screw with an inclination to a screw hole. On such an occasion, the screw is removed and retightened. Even when a threaded member has been properly tightened, the threaded member may be temporarily removed and retightened due to the wrong tightening order or in order to readjust the position of a member screwed to a product under assembling (half-finished product). Therefore, many motor-driven screwdrivers are equipped with a reversing function to switch the direction of rotation of a screwdriver bit to the reverse direction, thereby allowing screw tightening and removal to be performed with a single motor-driven screwdriver.

In a case where a screw tightening operation is performed while counting the number of tightened screws, when one screw has been removed, the count value needs to be returned to a one-preceding count value in order to make the count value match the number of actually tightened screws. For example, a motor-driven screwdriver of Patent Literature 1 is provided with a button for returning the count value, and when a screw has been removed, a worker presses the button to return the count value. There has also been developed a motor-driven screwdriver configured to automatically return the count value by judging that a screw has been removed when the screwdriver has been driven reversely.

CITATION LIST

Patent Literature

Patent Literature 1: Japanese Patent Number 4295063

SUMMARY OF INVENTION

Technical Problem

In the motor-driven screwdriver disclosed in Patent Literature 1, however, the count value is returned by the worker simply pressing the button, and the adjustment of the count value is not linked to the reverse driving of the motor-driven screwdriver. Therefore, the count value may be mistakenly returned although a screw removing operation has not actually been performed. With a motor-driven screwdriver in which the count value is automatically returned when the screwdriver bit is driven reversely, the count value is undesirably returned automatically also when the motor-driven screwdriver is driven reversely to remove a screw not properly tightened and hence not counted. That is, the motor-driven screwdrivers having the conventional counting functions suffer from the problem that the count value may fail to match the number of actually tightened screws. A similar problem may occur with a nut tightening tool for screwing a nut attached to a socket onto a bolt.

Accordingly, the present invention has been made in view of the above-described problems with the conventional techniques, and an object of the present invention is to provide a threaded member tightening tool for tightening threaded members such as screws and nuts, the threaded member tightening tool being capable of returning the count value in linkage with the reverse driving of the threaded member tightening tool and only when the count value needs to be returned (i.e. only when a threaded member to be removed by reverse driving has been counted as a tightened threaded member), or to provide a counting apparatus communicatively connected to a threaded member tightening tool and capable of returning the count value in linkage with the reverse driving of the threaded member tightening tool and only when the count value needs to be returned.

Solution to Problem

The present invention provides a threaded member tightening tool including the following: a tool body having an engaging element fitting unit to which a threaded member engaging element is to be fitted, and an electric motor rotationally driving the engaging element fitting unit; a forward-reverse rotation switching unit for switching a direction of rotation of the engaging element fitting unit by the electric motor between a forward direction and a reverse direction; a computing unit switchable between a counting mode in which the computing unit counts the number of threaded members tightened with the tool body and holds the counted number as a count value and a count return mode for returning the count value to a one-preceding count value; and a mode switching unit for switching the computing unit from the counting mode to the count return mode. The computing unit returns the count value to a one-preceding count value based on the fact that the engaging element fitting unit has been driven in the reverse direction when the computing unit has been switched to the count return mode.

In the above-described threaded member tightening tool, the computing unit returns the count value to a one-preceding count value based on the fact that the engaging element fitting unit has been driven in the reverse direction on the condition that the computing unit has been switched to the count return mode. Accordingly, the computing unit is enabled to return the count value to a one-preceding count value by switching the computing unit to the count return mode when it is recognized that the count value needs to be returned to a one-preceding count value, i.e. when it is recognized that because a threaded member to be removed by reverse driving has been counted as a tightened threaded member; therefore, when the threaded member has been removed, the count value needs to be returned to a one-preceding count value. With this structure, it is possible to prevent the count value from disagreeing with the number of actually tightened threaded members.

Specifically, the computing unit may be configured to return the count value to a one-preceding count value when the engaging element fitting unit has been driven in the reverse direction in response to starting of the electric motor in a state where the direction of rotation of the engaging element fitting unit has been set in the reverse direction through the forward-reverse rotation switching unit and where the computing unit has been switched to the count return mode by actuation of the mode switching unit.

The computing unit may be configured to cancel the count return mode when the computing unit has returned the count value to a one-preceding count value.

It may be necessary in order to remove one threaded member to drive the threaded member tightening tool reversely a plurality of times intermittently so as to remove the threaded member little by little. In such a case, with the above-described structure, the count value is returned to a one-preceding count value in response to a first reverse driving operation, and at that time, the count return mode is cancelled. Therefore, even if second and following reverse driving operations are performed successively to the first reverse driving operation, the count value cannot be further returned to a one-preceding count value. Accordingly, there is no possibility of the count value disagreeing with the number of actually tightened threaded members.

The computing unit may be configured to cancel the count return mode when the setting of the direction of rotation of the engaging element fitting unit is changed from the reverse direction during the count return mode. The computing unit may also be configured to cancel the count return mode when the engaging element fitting unit is driven in the reverse direction during the count return mode.

The threaded member tightening tool may further include a count return mode canceling unit, and the computing unit may be configured to cancel the count return mode when the count return mode canceling unit is actuated during the count return mode.

Preferably, the threaded member tightening tool may further include a count return mode display part displaying that the computing unit has been switched to the count return mode.

The arrangement may be as follows. The computing unit allows selection of a mode of counting the number of tightened threaded members from between a count-up mode and a count-down mode. When the count-up mode has been selected, the computing unit increments the count value by 1 upon completion of tightening of a threaded member and decrements the count value by 1 when the engaging element fitting unit has been driven in the reverse direction during the count return mode. When the count-down mode has been selected, the computing unit decrements the count value by 1 upon completion of tightening of a threaded member and increments the count value by 1 when the engaging element fitting unit has been driven in the reverse direction during the count return mode.

In addition, the present invention provides a counting apparatus for use in combination with a threaded member tightening tool having an engaging element fitting unit to which a threaded member engaging element is to be fitted, an electric motor capable of driving the engaging element fitting unit in either of a forward direction and a reverse direction, and a signal output unit, the counting apparatus being communicatively connected to the signal output unit. The counting apparatus includes a computing unit switchable between a counting mode in which the computing unit counts the number of tightened threaded members by receiving from the signal output unit a tightening completion signal indicating that the threaded member tightening tool has completed tightening of a threaded member and holds the counted number as a count value and a count return mode for returning the count value to a one-preceding count value. The computing unit returns the count value to a one-preceding count value when receiving from the signal output unit a drive signal indicating driving of the electric motor in the reverse direction in a state where the computing unit has been switched to the count return mode.

The counting apparatus may be regarded as an independent form of the computing unit of the above-described threaded member tightening tool. The counting apparatus is capable of accurately counting the number of tightened threaded members by receiving signals associated with a threaded member tightening operation from the threaded member tightening tool. Even a conventional threaded member tightening tool having no counting function can be made capable of counting the number of tightened threaded members by connecting the counting apparatus thereto, provided that the conventional threaded member tightening tool is configured to be able to output required signals. If the counting apparatus is communicatively connected to a plurality of threaded member tightening tools, tightening operations performed with the plurality of threaded member tightening tools can be collectively managed by the single counting apparatus. Further, if the counting apparatus is connected the above-described threaded member tightening tool having the counting function, the number of tightened threaded members can be counted at the threaded member tightening tool and used for the worker's operation, and at the same time, the number of tightened threaded members can also be counted at the counting apparatus and used to manage the operation.

Specifically, the computing unit may be configured to return the count value to a one-preceding count value when receiving from the signal output unit a signal indicating that the engaging element fitting unit has been driven in the reverse direction in response to starting of the electric motor in a state where the computing unit has received from the signal output unit a signal indicating that a forward-reverse rotation switching unit provided in the threaded member tightening tool has switched the driving direction of the electric motor to the reverse direction and where the computing unit has been switched to the count return mode.

The computing unit may be configured to cancel the count return mode when the computing unit has returned the count value to a one-preceding count value.

Further, the computing unit may be configured to cancel the count return mode when receiving a signal indicating that the driving direction of the electric motor has been changed from the reverse direction during the count return mode. The computing unit may also be configured to cancel the count return mode when receiving the drive signal indicating driving of the electric motor in the reverse direction during the count return mode.

The counting apparatus may further include a count return mode canceling unit, and the computing unit may be configured to cancel the count return mode when the count return mode canceling unit is actuated during the count return mode.

Preferably, the counting apparatus may further include a count return mode display part displaying that the computing unit has been switched to the count return mode.

Further, the arrangement may be as follows. The computing unit allows selection of a mode of counting the number of tightened threaded members from between a count-up mode and a count-down mode. When the count-up mode has been selected, the computing unit increments the count value by 1 when receiving the tightening completion signal and decrements the count value by 1 when receiving the drive signal during the count return mode and judging that the engaging element fitting unit of the threaded member tightening tool has been driven in the reverse direction, and when the count-down mode has been selected, the computing unit decrements the count value by 1 when receiving the tightening completion signal and increments the count value by 1 when receiving the drive signal during the count return mode and judging that the engaging element fitting unit of the threaded member tightening tool has been driven in the reverse direction.

Embodiments of a threaded member tightening tool according to the present invention will be explained below on the basis of the accompanying drawings.

DESCRIPTION OF EMBODIMENTS

Figure 1:
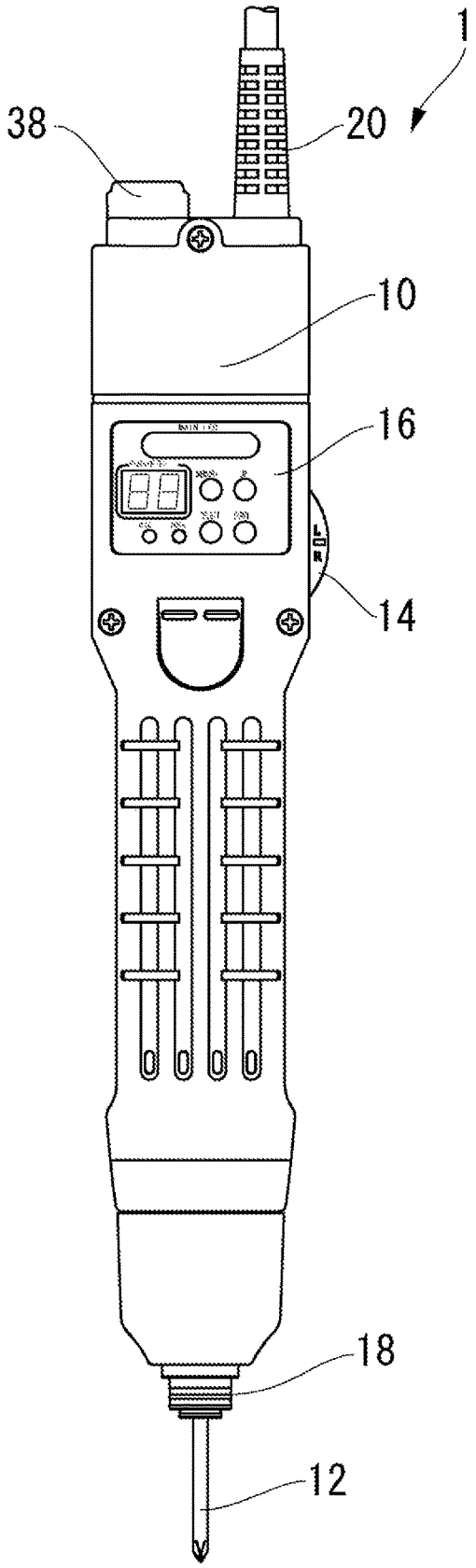
FIG. 1 is an external view of a motor-driven screwdriver according to one embodiment of a threaded member tightening tool of the present invention.

As shown in FIG. 1, a motor-driven screwdriver 1 according to one embodiment of a threaded member tightening tool of the present invention includes a motor-driven screwdriver body 10 having a built-in electric motor (not shown) and a bit holder (engaging element fitting unit) 18 rotationally driven by the electric motor. The motor-driven screwdriver 1 further includes a forward-reverse rotation changeover switch (forward-reverse rotation switching unit) 14 and an operation display unit 16, which are provided in the motor-driven screwdriver body 10. The bit holder 18 is detachably fitted with a screwdriver bit (threaded member engaging element) 12 appropriately selected in accordance with screws to be tightened. The motor-driven screwdriver 1 is supplied with electric power through a power supply cord 20.

The forward-reverse rotation changeover switch 14 is used to change over the rotational direction of the bit holder 18. When the forward-reverse rotation changeover switch 14 is turned to the R (clockwise rotation) side, the rotational direction of the bit holder 18 is set to the forward direction; when the forward-reverse rotation changeover switch 14 is turned to the L (counterclockwise rotation) side, the rotational direction of the bit holder 18 is set to the reverse direction. It should be noted that the forward direction is the direction for tightening a screw, and the reverse direction is the direction for loosening a screw. The motor-driven screwdriver 1 is provided in its motor-driven screwdriver body 10 with a starting switch (not shown) for starting the electric motor. The starting switch is turned on when the screwdriver bit 12 fitted to the bit holder 18 is pressed against a screw, and this causes the electric motor to start driving. At this time, the electric motor is driven to rotate the bit holder 18 in a rotational direction set through the forward-reverse rotation changeover switch 14. Accordingly, when the screwdriver bit 12 is pressed against a screw with the forward-reverse rotation changeover switch 14 turned to the R side, the bit holder 18 and the screwdriver bit 12 are driven to rotate forwardly, and thus a screw tightening operation is performed. When the screwdriver bit 12 is pressed against a screw with the forward-reverse rotation changeover switch 14 turned to the L side, the screwdriver bit 12 is driven reversely, and thus a screw removing operation is performed. It should be noted that when the forward-reverse rotation changeover switch 14 is placed in the middle between R and L, i.e. in a neutral position, the electric motor is not driven even if the starting switch is activated.

Figure 2:
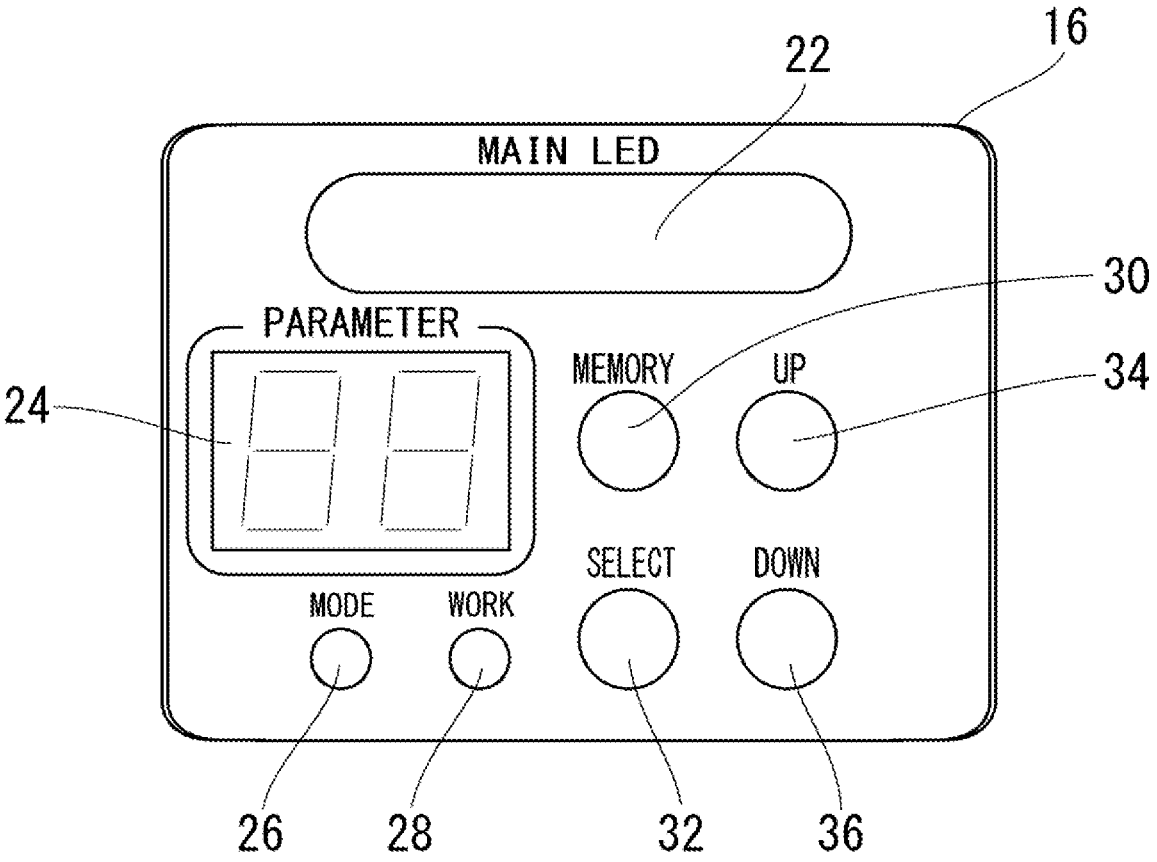
FIG. 2 is an illustration of an operation display unit of the motor-driven screwdriver shown in FIG. 1.

As shown in FIG. 2, on the operation display unit 16 are disposed various display parts including a main display part 22, a parameter display part 24, a mode display part 26, and a component placement display part 28, together with various operating units including a memory button 30, a select button 32, an up button 34, and a down button 36. The motor-driven screwdriver 1 is provided in its motor-driven screwdriver body 10 with a control circuit (computing unit) that performs various control operations upon receipt of input information from the above-described operating units, for example, changing various settings of the motor-driven screwdriver 1 and displaying various items of information on the above-described display parts.

A clutch mechanism (not shown) is disposed between the electric motor and the bit holder 18. The clutch mechanism is activated when a torque exceeding a predetermined value acts on the bit holder 18, to temporarily cancel the driving connection between the electric motor and the bit holder 18. The clutch mechanism prevents application of an excessive torque to a screw through the bit holder 18 and the screwdriver bit 12. The control circuit is configured to judge completion of a screw tightening operation by detecting an activation of the clutch mechanism, as will be explained later.

The motor-driven screwdriver body 10 has a signal input-output unit 38 provided at the rear end (upper end as viewed in the figure). The signal input-output unit 38 has a plurality of input and output terminals disposed therein. Connecting the motor-driven screwdriver 1 to another motor-driven screwdriver of the same type through the input and output terminals allows communication between the two motor-driven screwdrivers. If the motor-driven screwdriver body 10 is connected to an external device through the signal input-output unit 38, it is possible to change the settings of the motor-driven screwdriver 1 through the external device and it is also possible to control the motor-driven screwdriver 1 by inputting control signals such as a forced stop signal (described later) from the external device. Further, it is possible to output from the signal input-output unit 38 signals relating to a screw tightening operation (described later), such as an error signal and an OK signal, and it is also possible to transmit these signals to an external device connected to the signal input-output unit 38 and to display the transmitted information on the external device.

The control circuit has a function (counting mode) to count the number of screws tightened with the motor-driven screwdriver body 10 and to hold the counted number of tightened screws as a count value and a function (count return mode) to return the count value to a one-preceding count value, as will be explained later. Regarding the mode of counting the number of screws by the control circuit, either of count-up and count-down modes can be selected at will by a predetermined operation using the buttons of the operation display unit 16. In either of the two count modes, the number of screws to be tightened in one working process can be preset as a set number of screws to be tightened. In the count-up mode, the control circuit sets the initial value of the count value to "0" and counts in such a manner as to increment the count value by 1 every time a screw tightening operation has been properly completed. When the count value becomes equal to the set number of screws to be tightened, the control circuit judges that tightening of all screws to be tightened in the present working process has been completed. On the other hand, in the count-down mode, the control circuit sets the initial value of the count value to a set number of screws to be tightened and counts in such a manner as to decrement the count value by 1 every time a screw tightening operation has been properly completed. When the count value becomes "0", the control circuit judges that tightening of all screws to be tightened in the present working process has been completed. For example, when the set number of screws to be tightened has been set to "10" and the count-up mode has been selected, the count value is set to "0" at the time of starting the work, and every time screw tightening has been properly completed, the count value is successively incremented as follows: "1, 2, 3 . . . ". When the count value has reached "10", which is the set number of screws to be tightened, the control circuit judges that screw tightening in the present working process has been completed. When the count-down mode has been selected, the count value is set to "10" at the time of starting the work, and every time screw tightening has been properly completed, the count value is successively decremented as follows: "9, 8, 7 . . . ". When the count value has reached "0", the control circuit judges that screw tightening in the present working process has been completed. The parameter display part 24 also functions as a count display part, and the count value is always displayed on the parameter display part 24. The worker himself or herself can confirm how screw tightening is progressing from the count value displayed on the parameter display part 24.

Completion of tightening of each screw is automatically judged from an activation of the clutch mechanism. That is, when a screw has been tightened to such an extent that the screw cannot turn any further, a great torque is applied to the clutch mechanism, and thus the clutch mechanism is activated. In this regard, the motor-driven screwdriver 1 is provided with a sensor that detects an activation of the clutch mechanism. When the sensor reacts, the control circuit judges that a screw has been tightened. Whether or not screw tightening has been properly completed is judged mainly from whether or not screw tightening has been completed within a predetermined time. More specifically, the motor-driven screwdriver 1 is configured to enable a screw tightening lower-limit time and a screw tightening upper-limit time to be set at will. The control circuit judges that screw tightening has been properly completed when the screw tightening has been completed at a time between the screw tightening lower-limit time and the screw tightening upper-limit time. When screw tightening has been completed at a time outside the above-described range of time, the control circuit sends an error signal, and error information is displayed on the parameter display part 24. Also, when a screw tightening operation is interrupted before the completion of screw tightening, i.e. when the screwdriver bit 12 is separated from a screw and thus the driving of the electric motor is stopped before the completion of screw tightening, the control circuit sends an error signal, and error information is displayed on the parameter display part 24.

A screwdriver bit 12 to be used, a rotational speed, a screw tightening lower-limit time, and a screw tightening upper-limit time are determined according to the type of screws to be tightened. Therefore, it is necessary to change driving setting parameters such as the screw tightening lower-limit time, the screw tightening upper-limit time, and the rotational speed for each type of screws to be tightened. In this regard, the motor-driven screwdriver 1 can store in advance parameter groups appropriate for a maximum of 8 different types of screws. For example, driving setting parameters appropriate for screws a are stored in advance as a parameter group A. Similarly, driving setting parameters appropriate for screws b are stored in advance as a parameter group B, and driving setting parameters appropriate for screws c are stored in advance as a parameter group C. Any of the parameter groups can be properly selected in accordance with screws to be tightened.

Further, the motor-driven screwdriver 1 allows a predetermined order of application of parameter groups to be set in advance. For example, for a working process in which screws a, screws b, and screws c are to be sequentially tightened, it is set in advance such that the parameter groups A, B and C will be applied in the order mentioned. Consequently, the parameter group A is applied at the time of starting a screw tightening operation. When tightening of screws a has been properly completed under the setting of the parameter group A, the parameter group B is automatically applied subsequently. Similarly, when tightening of screws b has been completed under the setting of the parameter group B, the parameter group C is automatically applied subsequently. In what order parameter groups should be applied can be set at will. It is also possible to previously store a plurality of patterns each indicating an order of application of such parameter groups.

During a screw tightening operation in a working process, there may be a case where a screw needs to be temporarily removed because screw tightening could not be properly performed due to a failure in the screw tightening operation or because it becomes necessary afterwards to correct the position of a member assembled to a half-finished product, for example, although screw tightening for the assembled member has been properly performed. In such a case, the forward-reverse rotation changeover switch 14 is turned to the L (reverse rotation) side to drive the screwdriver bit 12 reversely, thereby removing the screw to be removed temporarily.

To perform a screw removing operation, when the down button 36, which functions as a mode switching unit, is pressed in a state where the rotational direction of the screwdriver bit 12 has been set to the reverse direction by turning the forward-reverse rotation changeover switch 14 to the L (reverse rotation) side, the control circuit is switched from the counting mode of counting the number of tightened screws to the count return mode, as has been stated above. When the starting switch is activated in the count return mode and thus the bit holder 18 is driven reversely, the control circuit returns the count value to a one-preceding count value. The term "the control circuit returns the count value to a one-preceding count value" as used herein means that the control circuit returns the count value to the immediately preceding count value. Specifically, when the count-up mode has been selected as a count mode, the above-described term means that the control circuit decrements the count value by 1. When the count-down mode has been selected, the above-described term means that the control circuit increments the count value by 1. For example, if a screw removing operation is performed in the count return mode in a situation where a screw tightening operation has been repeatedly performed in the count-up mode and thus the count value has been incremented as follows: "0, 1, 2", the count value is decremented from "2" by 1 and thus returned to "1", which is a one-preceding count value. If a screw removing operation is performed in the count return mode in a situation where a screw tightening operation has been repeatedly performed in the count-down mode and thus the count value has been decremented as follows: "10, 9, 8", the count value is incremented from "8" by 1 and thus returned to "9", which is a one-preceding count value. On the other hand, the count value is not changed but left as it is, no matter which count mode has been selected, if the bit holder 18 is driven reversely in a state where the rotational direction of the bit holder 18 has been set to the reverse direction by turning the forward-reverse rotation changeover switch to the L (reverse rotation) side and where the down button 36, which functions as a mode switching unit, is not actuated, i.e. without switching the control circuit to the count return mode. It should be noted that the main display part 22 also functions as a count return mode display part, and that when the control circuit is switched to the count return mode, the main display part 22 lights up in blue. When the count value is an initial value, the count value cannot be returned any further; therefore, the control circuit does not switch to the count return mode, and error information is displayed on the parameter display part 24.

In the motor-driven screwdriver 1, the count value is returned to a one-preceding count value when the bit holder 18 has been driven in the reverse direction in a state where the control circuit has been switched to the count return mode by actuating the down button 36, which functions as a mode switching unit. Accordingly, the count value is returned only when the count value needs to be returned (i.e. when a threaded member to be removed by reverse driving has been counted as a tightened threaded member) and a screw removing operation has been actually performed with the motor-driven screwdriver 1. When screw tightening has not been properly performed due to a failure in the screw tightening operation, for example, the control circuit does not count the screw concerned. Accordingly, if the count value is returned when the screw that has not been counted is removed, there will be a mismatch between the count value and the number of actually tightened screws. Therefore, in such a case, the screw concerned is removed without switching to the count return mode. There may be a situation where, although a screw has been properly tightened, the screw needs to be removed afterwards in order to correct the position of a member fastened with the screw, for example. In such a case, the screw concerned is removed with the control circuit switched to the count return mode, thereby returning the count value to a one-preceding count value. By so doing, the match between the count value and the number of actually tightened screws can be maintained.

Once the bit holder 18 is driven reversely during the count return mode, the control circuit cancels the count return mode. Therefore, when a plurality of properly tightened screws are to be removed successively, the down button 36 is pressed to switch the control circuit to the count return mode every time a properly tightened screw is to be removed, and thereafter, a screw removing operation is performed. The arrangement may be such that the control circuit cancels the count return mode when the forward-reverse rotation changeover switch 14 is turned to the R (forward rotation) side to set the rotational direction to the forward direction during the count return mode. The arrangement may also be such that the control circuit cancels the count return mode when the select button 32, which functions as a count return mode canceling unit, is pressed for a long time during the count return mode.

A component placement signal can be input to the signal input-output unit 38. The component placement signal is a signal indicating that a component (half-finished product) to be fastened with screws has been placed in a predetermined working position. A sensor that detects that the component has been placed in a predetermined working position is installed separately, and the signal input-output unit 38 receives a signal from the sensor, thereby detecting that the component has been correctly placed. When receiving the component placement signal, the control circuit enables the electric motor to be driven; when receiving no component placement signal, the control circuit disables the electric motor from being driven. When the component placement signal is input to the signal input-output unit 38, the component placement display part 28 lights up.

Upon completion of a proper screw tightening operation to tighten a set number of screws to be tightened, i.e. all screws to be tightened in one working process, the main display part 22 lights up in green. Thereafter, the worker visually confirms that all the screws have been properly tightened before a preset screw tightening confirmation time has elapsed. If there is a screw not tightened properly, the worker temporarily removes and retightens the screw. The screw tightening confirmation time is provided to give the worker a period of time for finally confirming a tentatively completed screw tightening operation without returning the count value, which has reached the set number of screws to be tightened, to the initial value immediately after all the screws to be tightened have been tightened. When the screw tightening confirmation time has elapsed, the control circuit sends a signal (OK signal) indicating that all the screw tightening operations in one working process have been properly completed, and the main display part 22 lights up in blue. When the OK signal is sent, the worker is allowed to remove the component fastened with the screws from the working position and to move on to a screw tightening operation for a component to be subjected to a subsequent working process. When a component to be fastened with screws disappears from the working position, the main display part 22 is lit off. It should be noted that if a component to be fastened with screws is removed in a state where no OK signal is available, the control circuit sends an NG signal, and error information concerning this fact is displayed on the parameter display part 24.

The necessary length of time for the above-described screw tightening confirmation differs depending on the set number of screws to be tightened, the worker's skill level, etc. Therefore, the motor-driven screwdriver 1 is configured to allow the screw tightening confirmation time to be set at will. Thus, it is possible to improve the efficiency of screw tightening while ensuring the reliability of the screw tightening operation.

The OK signal is, basically, sent after the screw tightening confirmation time has elapsed. However, the OK signal can be sent even before the screw tightening confirmation time has elapsed by pressing the up button 34. Consequently, screw tightening for a component to be subjected to a subsequent working process can be started even more quickly in accordance with each particular situation.

If some error occurs, i.e. if screw tightening cannot be completed within a period of time between the screw tightening lower-limit time and the screw tightening upper-limit time, for example, the control circuit sends an error signal, and error information is displayed on the parameter display part 24, as has been stated above. While error information is being displayed on the parameter display part 24, the motor-driven screwdriver 1 does not drive the electric motor. The error information disappears from the parameter display part 24 in response to pressing the up button 34 or inputting a predetermined error cancellation signal to the signal input-output unit 38, and this allows the motor-driven screwdriver 1 to return to a drivable state. Thus, the error information is kept displayed until the worker performs a predetermined operation, thereby allowing the worker to surely grasp the error information. It should be noted that it is also possible to configure such that the error information automatically disappears when a predetermined time has elapsed since the occurrence of the error.

A forced stop signal can also be externally input to the signal input-output unit 38. When the forced stop signal is input to the signal input-output unit 38, the electric motor of the motor-driven screwdriver 1 is disabled from being driven. When the forced stop signal is input to the signal input-output unit 38 while the electric motor is being driven, the electric motor is forcedly stopped.

The signal input-output unit 38 has an input terminal for inputting the above-described forced stop signal. The input terminal can be used as a terminal for inputting another signal by changing the settings. For example, the input terminal can be changed to an input terminal for a reset signal to return the settings of the motor-driven screwdriver 1 to the initial state. By making a single terminal usable for a plurality of purposes as stated above, it is possible to reduce the number of terminals required and hence possible to make the signal input-output unit 38 compact.

The motor-driven screwdriver 1 enters into a password input state in response to turning on the power supply and is enabled to be driven when a preset password is entered. It should be noted that setting of a password is optional and that the motor-driven screwdriver 1 may be enabled to be driven immediately when the power supply is turned on, without entering a password.

Figure 3:
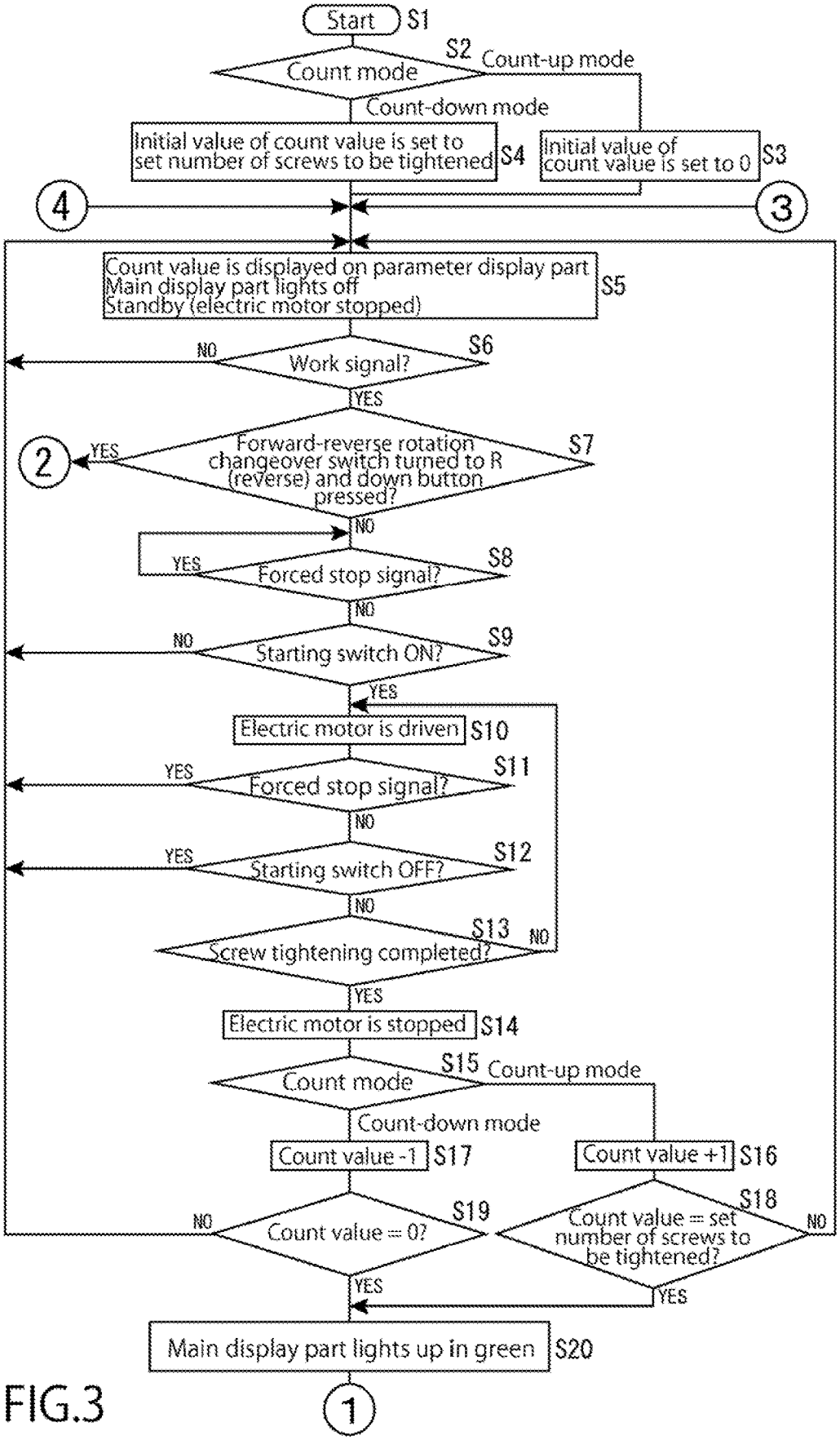
FIG. 3 is a first flowchart showing an operation of the motor-driven screwdriver in FIG. 1.
Figure 4:
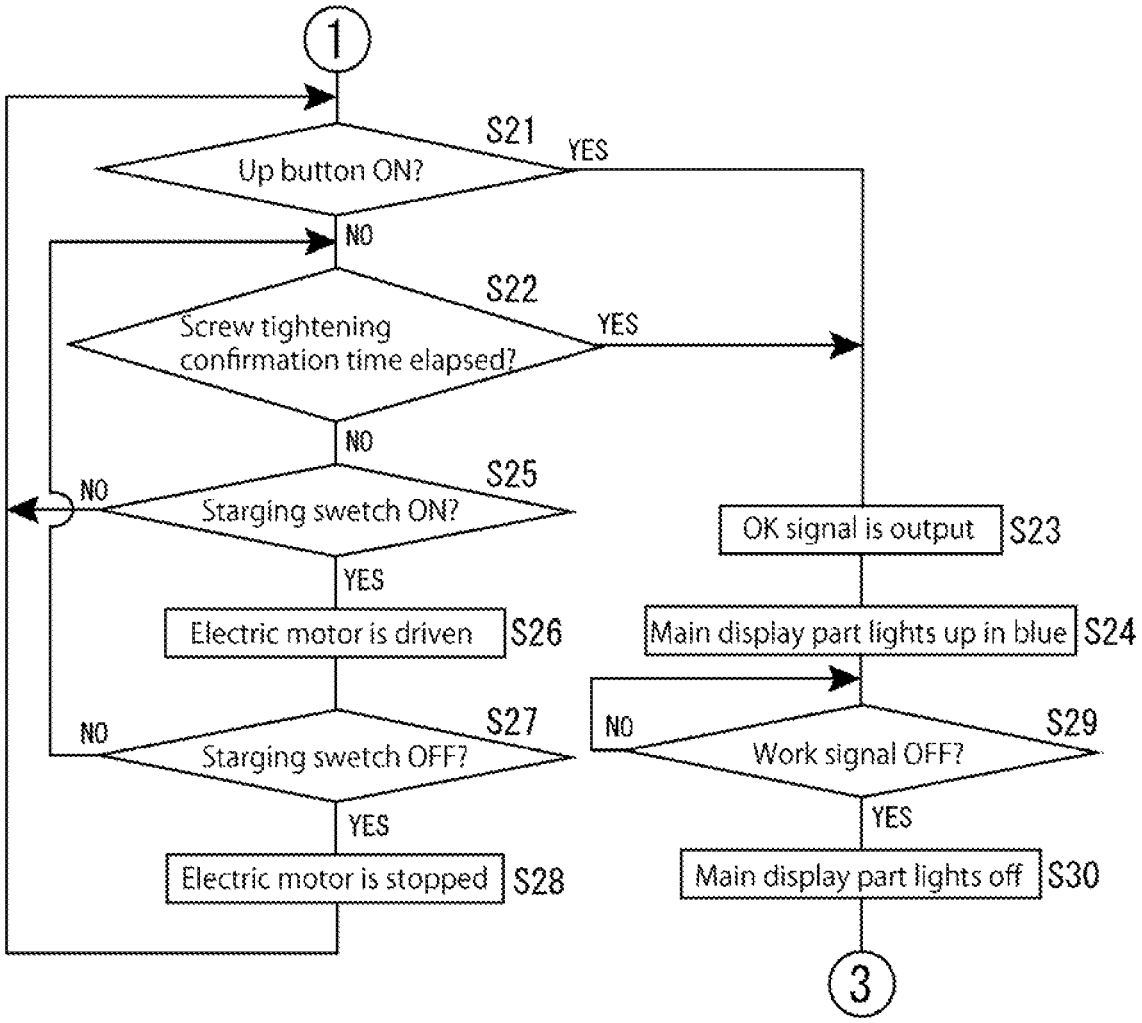
FIG. 4 is a second flowchart showing an operation of the motor-driven screwdriver in FIG. 1.
Figure 5:
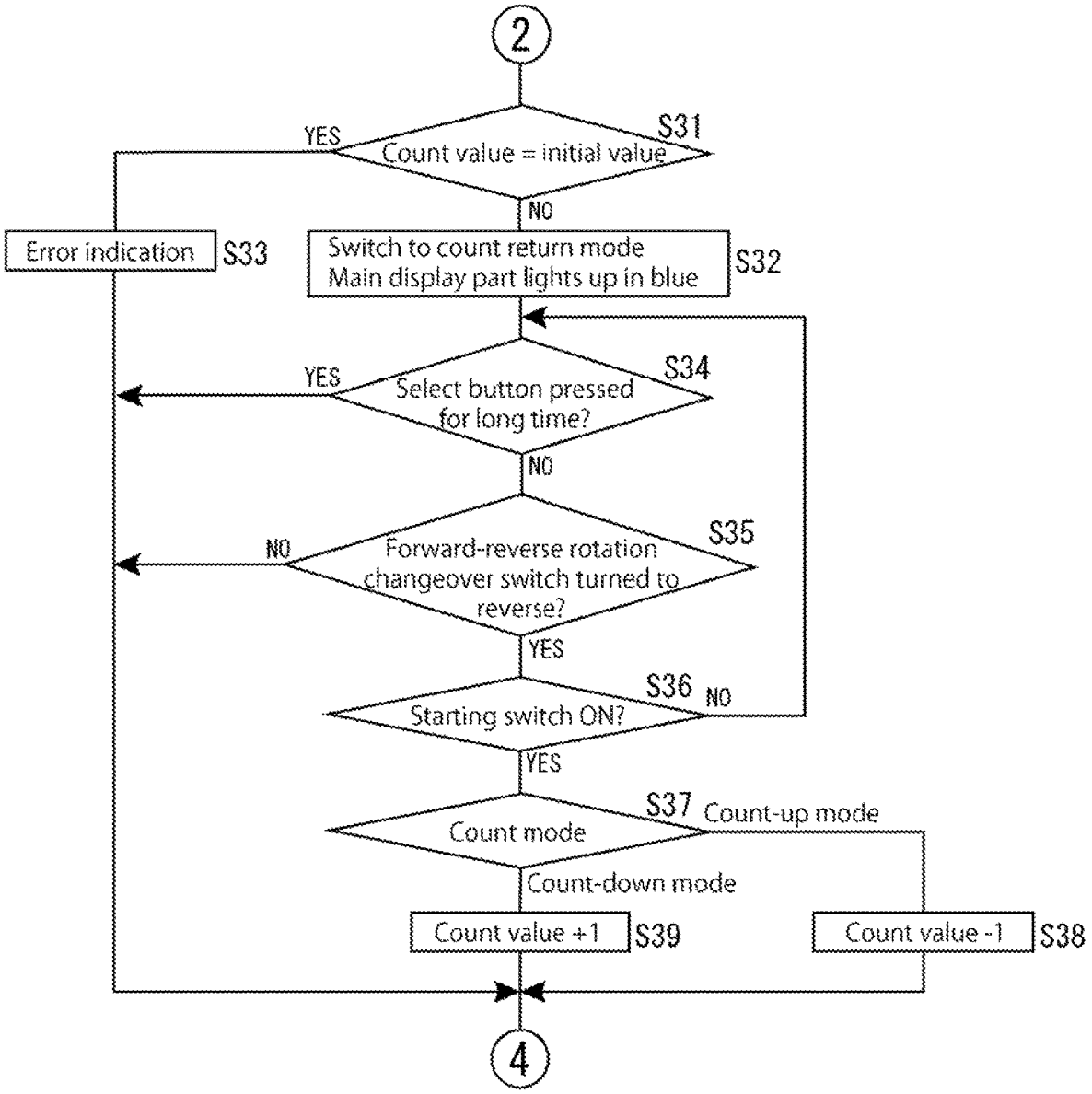
FIG. 5 is a third flowchart showing an operation of the motor-driven screwdriver in FIG. 1.

A basic operation of the motor-driven screwdriver 1 will be explained on the basis of flowcharts shown in FIGS. 3 to 5. When a power supply is connected to the motor-driven screwdriver 1 through the power supply cord 20, the motor-driven screwdriver 1 is started (S1). Subsequently, when the count-up mode has been selected (S2), the initial value of the count value is set to "0" (S3); when the count-down mode has been selected (S2), the initial value of the count value is set to a preset number of screws to be tightened (S4). The count value is displayed on the parameter display part 24, and the main display part 22 lights off, and further the electric motor is stopped (S5). When a component to be fastened with screws is placed in an appropriate position and consequently a component placement signal is input, the electric motor is enabled to be driven (S6). At this time, if a forced stop signal has been input, the electric motor is kept stopped (S8). When no forced stop signal has been input, rotational drive of the electric motor is started in response to an activation of the starting switch (S9, S10). At this time, the rotational direction of the electric motor, i.e. the rotational direction of the bit holder 18, is a direction set with the forward-reverse rotation changeover switch 14. It should be noted that if a forced stop signal is input (S11) or if the starting switch is turned off (S12) after the electric motor has been driven, the electric motor is stopped (S5). When screw tightening has been properly completed (S13), the electric motor is stopped (S14). Next, when the count-up mode has been selected (S15), the control circuit increments the count value by 1 (S16); when the count-down mode has been selected (S15), the control circuit decrements the count value by 1 (S17). In this way, the screw tightening operation is repeated, and when the count value becomes equal to the set number of screws to be tightened in the count-up mode (S18), or when the count value becomes equal to "0" in the count-down mode (S19), the main display part 22 lights up in green to indicate that all the screw tightening operations have been completed (S20). Next, when the up button 34 is pressed (S21) or when the screw tightening confirmation time has elapsed (S22), it is judged that screw tightening has been properly completed, and an OK signal is sent (S23). Further, the main display part 22 lights up in blue (S24). It should be noted that before the screw tightening confirmation time has elapsed, the electric motor may be enabled to be driven in response to turning on the starting switch in order, for example, to retighten a screw (S25-S28). Thereafter, when the component fastened with the screws has been removed from the working position, the component placement signal turns off (S29), and the main display part 22 lights off to indicate that one working process has been completed (S30).

When, in the middle of a screw tightening operation, the down button 36 is pressed (S7) in a state where the rotation of the bit holder 18 has been set to the reverse direction by turning the forward-reverse rotation changeover switch 14 to the L side and when the current count value is not the initial value (S31), the control circuit switches from the counting mode to the count return mode, and the main display part 22 (count return mode display part) lights up in blue (S32). It should be noted that when the count value is equal to the initial value, the control circuit sends an error signal, and error information is displayed on the parameter display part 24 (S33). When, during the count return mode, the select button 32 is pressed for a long time (S34), or when the setting of the rotational direction of the bit holder 18 is changed from the reverse direction (S35) by turning the forward-reverse rotation changeover switch 14 from the L side (reverse rotation) to the neutral or R side (forward rotation), the count return mode is canceled. When the starting switch is activated (S36) during the count return mode, it is judged that a screw removing operation has been performed, and the control circuit decrements the count value by 1 (S38) when the count-up mode has been selected (S37). When the count-down mode has been selected (S37), the control circuit increments the count value by 1 (S39). Thereafter, the control circuit cancels the count return mode.

Although in the above-described embodiment the forward-reverse rotation switching unit, the mode switching unit, and the count return mode canceling unit are formed by the switch 14 and the buttons 30 to 36 of the operation display unit 16, which are provided in the motor-driven screwdriver body 10, a part or all of the above-described parts may be formed by a remote controller performing radio communication with the control circuit or an external device connected to the signal input-output unit 38, for example.

Figure 6:
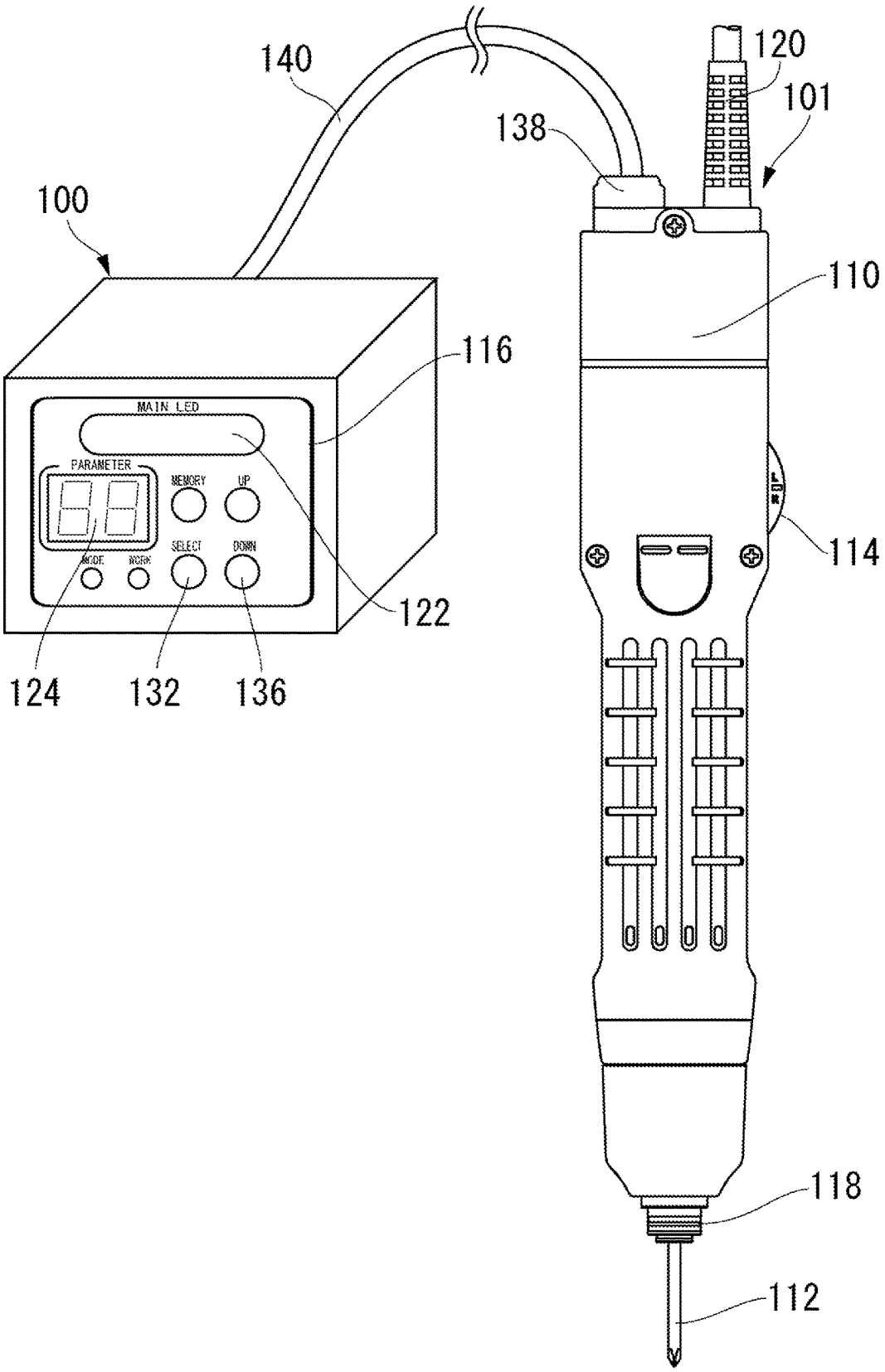
FIG. 6 is an illustration of a counting apparatus according to one embodiment of the present invention, showing the way in which the counting apparatus is communicatively connected to a motor-driven screwdriver.

As shown in FIG. 6, a counting apparatus 100 according to one embodiment of the present invention can be communicatively connected to a motor-driven screwdriver 101 through a signal wiring 140. The counting apparatus 100 has an operation display unit 116 similar to the operation display unit 16 provided in the motor-driven screwdriver 1 of the above-described embodiment. Further, the counting apparatus 100 has a power supply cord (not shown) through which electric power is supplied to the counting apparatus 100.

The motor-driven screwdriver 101 differs from the motor-driven screwdriver 1 of the above-described embodiment mainly in that the motor-driven screwdriver 101 does not have the counting function and the operation display unit 16. The motor-driven screwdriver 101 has an electric motor, a motor-driven screwdriver body 110, a screwdriver bit 112, a forward-reverse rotation changeover switch 114, a bit holder 118 a power supply cord 120, a signal input-output unit 138, and a clutch mechanism, in the same way as the motor-driven screwdriver 1. The structures and functions of these constituent elements are common to those of the motor-driven screwdriver 1; therefore, a detailed explanation thereof is herein omitted. It should, however, be noted that the signal input-output unit 138 outputs the following signals: a tightening completion signal indicating that screw tightening has been properly completed; rotational direction setting signals (reverse setting signal, forward setting signal, and neutral setting signal) indicating to which of L (reverse), R (forward) and neutral directions the rotational direction of the bit holder 118 has been set with the forward-reverse rotation changeover switch 114; and a drive signal indicating that the bit holder 118 is being driven by the electric motor.

The counting apparatus 100 has a computing circuit having a function (counting mode) to count the number of screws tightened with the motor-driven screwdriver 101 and to hold the counted number of tightened screws as a count value and a function (count return mode) to return the count value to a one-preceding count value, as will be explained later, in the same way as the control circuit (computing unit) of the above-described motor-driven screwdriver 1. The computing circuit switches from the counting mode to the count return mode when a down button (mode switching unit) provided in the counting apparatus is actuated in a state where the computing circuit is receiving from the signal input-output unit 138 of the motor-driven screwdriver 101 a reverse setting signal indicating that the forward-reverse rotation changeover switch 114 has been turned to L (reverse rotation) as a rotational direction setting signal. The computing circuit returns the tightened screw count value to a one-preceding count value when receiving a drive signal during the count return mode and judging that the bit holder of the motor-driven screwdriver body has been driven in the reverse direction. It should be noted that, in the counting apparatus 100, the computing circuit judges that the bit holder 118 has been driven in the reverse direction when receiving a drive signal while receiving a reverse setting signal. In this regard, however, if the motor-driven screwdriver 101 is configured to output a reverse drive signal indicating that the bit holder 118 has been driven in the reverse direction, the computing circuit may make the above-described judgment when receiving the reverse drive signal. The count value counted by the computing circuit is always displayed on a parameter display part 124, so that the worker can confirm the count value. The computing circuit allows selection of a count mode from between a count-up mode and a count-down mode, in the same way as the motor-driven screwdriver 1. It should be noted that a main display part 122 also functions as a count return mode display part. When the computing circuit switches to the count return mode, the main display part 122 lights up in blue. When the count value is equal to a preset initial value, the count value cannot be returned any further; therefore, the computing circuit does not switch to the count return mode, and error information is displayed on the parameter display part 124.

Once receiving a drive signal as a result of the motor-driven screwdriver 101 being driven during the count return mode, the computing circuit cancels the count return mode. Therefore, when a plurality of properly tightened screws are to be removed successively, every time a properly tightened screw is to be removed, a down button 136 needs to be pressed to switch the computing circuit to the count return mode before a screw removing operation is performed with the motor-driven screwdriver 101. When no reverse setting signal is received any longer during the count return mode (i.e. when a forward setting signal or a neutral setting signal is received as a rotational direction setting signal as a result of the forward-reverse rotation changeover switch 114 being turned to R (forward rotation) or neutral), the computing circuit cancels the count return mode. Also, when a select button 132, which functions as a count return mode canceling unit, is pressed for a long time during the count return mode, the computing circuit cancels the count return mode.

The above-described counting apparatus 100 enables a counting function to be added to the motor-driven screwdriver 101, which has no counting function. If the counting apparatus 100 is communicatively connected to a plurality of motor-driven screwdrivers, screw tightening operations performed by the plurality of motor-driven screwdrivers can be collectively managed by the single counting apparatus 100. Such collective management may be performed as follows. The above-described motor-driven screwdriver 1 is used as each motor-driven screwdriver connected to the counting apparatus 100, and a worker himself or herself sets operating parameters and performs operations at each motor-driven screwdriver 1. At the same time, the worker transmits from the signal input-output unit 38 data necessary for computing in the counting mode and count return mode at the counting apparatus 100, thereby collectively managing data. It should be noted that although the counting apparatus 100 of the above-described embodiment is communicatively connected to a motor-driven screwdriver through the signal wiring 140, the counting apparatus 100 may be communicatively connected to a motor-driven screwdriver wirelessly.

In either of the above-described embodiments, the motor-driven screwdriver 1 (101) has been explained as one embodiment of the threaded member tightening tool, by way of example. The present invention may, however, also be used as a threaded member tightening tool other than motor-driven screwdrivers for screw tightening by replacing the screwdriver bit 12 (112) attached to the bit holder 18 (118) with a tip tool bit of other form. For example, if a socket bit engageable with a nut is used as a tip tool bit, a nut tightening tool is obtained. If a hexagon bit engageable with a hexagon socket head bolt is used as a tip tool bit, a bolt tightening tool is obtained. Further, the threaded member engaging element, which is engageable with threaded members such as screws and nuts, and the engaging element fitting unit, to which the threaded member engaging element is to be fitted, need not necessarily have configurations such as those of the screwdriver bit 12 (112) and the bit holder 18 (118) in the above-described embodiments but may have various other configurations. The arrangement may, for example, be such that the engaging element fitting unit has a shaft-shaped portion, and the threaded member engaging element comprises a socket-shaped portion configured to receive and secure the shaft-shaped portion.

LIST OF REFERENCE SIGNS

Motor-driven screwdriver 1; motor-driven screwdriver body 10; screwdriver bit 12; forward-reverse rotation changeover switch 14; operation display unit 16; bit holder 18; power supply cord 20; main display part 22; parameter display part 24; mode display part 26; component placement display part 28; memory button 30; select button 32; up button 34; down button 36; signal input-output unit 38; counting apparatus 100; motor-driven screwdriver 101; motor-driven screwdriver body 110; screwdriver bit 112; forward-reverse rotation changeover switch 114; bit holder 118; main display part 122; parameter display part 124; select button 132; down button 136; signal input-output unit 138; signal wiring 140.

The invention claimed is:

1. A threaded member tightening tool comprising:

a tool body having an engaging element fitting unit to which a threaded member engaging element is to be fitted, and an electric motor rotationally driving the engaging element fitting unit;

a forward-reverse rotation switching unit for switching a direction of rotation of the engaging element fitting unit by the electric motor between a forward direction and a reverse direction;

a computing unit switchable between a counting mode in which the computing unit counts a number of threaded members tightened with a threaded member engaging element fitted to the engaging element fitting unit and rotated by the electric motor and holds the counted number as a count value and a count return mode for returning the count value to a one-preceding count value; and a mode switching unit for switching the computing unit from the counting mode to the count return mode;

wherein the computing unit returns the count value to a one-preceding count value in response to the engaging element fitting unit having been driven in the reverse direction with the computing unit having been switched to the count return mode, and the computing unit does not change the count value in response to the engaging element fitting unit having been driven in the reverse direction with the computing unit remaining in the counting mode and not having been switched to the count return mode.

2. The threaded member tightening tool of claim 1, wherein the computing unit returns the count value to a one-preceding count value when the engaging element fitting unit has been driven in the reverse direction in response to starting of the electric motor in a state where the direction of rotation of the engaging element fitting unit has been set in the reverse direction through the forward-reverse rotation switching unit and where the computing unit has been switched to the count return mode by actuation of the mode switching unit.

3. The threaded member tightening tool of claim 1, wherein the computing unit cancels the count return mode when the computing unit has returned the count value to a one-preceding count value.

4. The threaded member tightening tool of claim 1, wherein the computing unit cancels the count return mode when setting of the direction of rotation of the engaging element fitting unit is changed from the reverse direction during the count return mode.

5. The threaded member tightening tool of claim 1, wherein the computing unit cancels the count return mode when the engaging element fitting unit is driven in the reverse direction during the count return mode.

6. The threaded member tightening tool of claim 1, further comprising a count return mode canceling unit, wherein the computing unit cancels the count return mode when the count return mode canceling unit is actuated during the count return mode.

7. The threaded member tightening tool of claim 1, further comprising:

a count return mode display part displaying that the computing unit has been switched to the count return mode.

8. The threaded member tightening tool of claim 1, wherein the computing unit allows selection of a mode of counting a number of tightened threaded members from between a count-up mode and a count-down mode, and wherein when the count-up mode has been selected, the computing unit increments the count value by 1 upon completion of tightening of a threaded member and decrements the count value by 1 when the engaging element fitting unit has been driven in the reverse direction during the count return mode, and when the count-down mode has been selected, the computing unit decrements the count value by 1 upon completion of tightening of a threaded member and increments the count value by 1 when the engaging element fitting unit has been driven in the reverse direction during the count return mode.

9. A counting apparatus for use in combination with a threaded member tightening tool having an engaging element fitting unit to which a threaded member engaging element is to be fitted, an electric motor capable of driving the engaging element fitting unit in either of a forward direction and a reverse direction, and a signal output unit, the counting apparatus being configured to be communicatively connected to the signal output unit, the counting apparatus comprising:

a computing unit switchable between a counting mode in which the computing unit counts a number of tightened threaded members by receiving from the signal output unit a tightening completion signal indicating that the threaded member tightening tool has completed tightening of a threaded member and holds the counted number as a count value and a count return mode for returning the count value to a one-preceding count value; and a mode switching unit for switching the computing unit from the counting mode to the count return mode;

wherein the computing unit returns the count value to a one-preceding count value in response to the computing unit having received from the signal output unit a drive signal indicating driving of the electric motor in the reverse direction with the computing unit having been switched to the count return mode, and the computing unit does not change the count value in response to the computing unit having received from the signal output unit the drive signal indicating driving of the electric motor in the reverse direction with the computing unit remaining in the counting mode and not having been switched to the count return mode.

10. The counting apparatus of claim 9, wherein the computing unit returns the count value to a one-preceding count value when receiving from the signal output unit a signal indicating that the engaging element fitting unit has been driven in the reverse direction in response to starting of the electric motor in a state where the computing unit has received from the signal output unit a signal indicating that a forward-reverse rotation switching unit provided in the threaded member tightening tool has switched a driving direction of the electric motor to the reverse direction and where the computing unit has been switched to the count return mode.

11. The counting apparatus of claim 9, wherein the computing unit cancels the count return mode when the computing unit has returned the count value to a one-preceding count value.

12. The counting apparatus of claim 11, wherein the computing unit cancels the count return mode when receiving a signal indicating that the driving direction of the electric motor has been changed from the reverse direction during the count return mode.

13. The counting apparatus of claim 9, wherein the computing unit cancels the count return mode when receiving the drive signal indicating driving of the electric motor in the reverse direction during the count return mode.

14. The counting apparatus of claim 9, further comprising a count return mode canceling unit, wherein the computing unit cancels the count return mode when the count return mode canceling unit is actuated during the count return mode.

15. The counting apparatus of claim 9, further comprising:

a count return mode display part displaying that the computing unit has been switched to the count return mode.

16. The counting apparatus of claim 9, wherein the computing unit allows selection of a mode of counting a number of tightened threaded members from between a count-up mode and a count-down mode, and wherein when the count-up mode has been selected, the computing unit increments the count value by 1 when receiving the tightening completion signal and decrements the count value by 1 when receiving the drive signal during the count return mode and judging that the engaging element fitting unit of the threaded member tightening tool has been driven in the reverse direction, and when the count-down mode has been selected, the computing unit decrements the count value by 1 when receiving the tightening completion signal and increments the count value by 1 when receiving the drive signal during the count return mode and judging that the engaging element fitting unit of the threaded member tightening tool has been driven in the reverse direction.

* * * * *